US007481718B2

(12) United States Patent
Soracco

(10) Patent No.: US 7,481,718 B2
(45) Date of Patent: Jan. 27, 2009

(54) GOLF CLUB HEAD WITH TOP LINE INSERT

(75) Inventor: Peter L. Soracco, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/843,622

(22) Filed: May 12, 2004

(65) Prior Publication Data

US 2005/0255938 A1 Nov. 17, 2005

(51) Int. Cl.
*A63B 53/04* (2006.01)

(52) U.S. Cl. ..... 473/332; 473/349; 473/350

(58) Field of Classification Search ..... 473/329, 473/332, 345–356, 342
See application file for complete search history.

(56) References Cited

U.S. PATENT DOCUMENTS

| | | | | | |
|---|---|---|---|---|---|
| 1,319,233 | A | | 10/1919 | Mattern | |
| 2,429,351 | A | * | 10/1947 | Fetterolf | 473/329 |
| 3,084,940 | A | * | 4/1963 | Cissel | 473/332 |
| 3,881,733 | A | * | 5/1975 | Csernits | 473/330 |
| 3,970,236 | A | * | 7/1976 | Rogers | 228/196 |
| 4,027,885 | A | * | 6/1977 | Rogers | 473/342 |
| 4,340,230 | A | * | 7/1982 | Churchward | 473/339 |
| 4,398,965 | A | * | 8/1983 | Campau | 148/522 |
| 4,523,759 | A | * | 6/1985 | Igarashi | 473/346 |
| 4,607,846 | A | | 8/1986 | Perkins | |
| D321,920 | S | | 11/1991 | Parente et al. | |
| 5,221,087 | A | | 6/1993 | Fenton et al. | |
| D339,183 | S | | 9/1993 | Stites, III | |
| D343,216 | S | | 1/1994 | Chorne | |
| 5,377,979 | A | * | 1/1995 | Long | 473/310 |
| 5,492,327 | A | * | 2/1996 | Biafore, Jr. | 473/332 |
| 5,564,705 | A | * | 10/1996 | Kobayashi et al. | 473/334 |
| 5,616,088 | A | * | 4/1997 | Aizawa et al. | 473/341 |
| 5,669,826 | A | * | 9/1997 | Chang et al. | 473/332 |
| 5,772,527 | A | * | 6/1998 | Liu | 473/324 |
| 6,042,486 | A | * | 3/2000 | Gallagher | 473/329 |
| 6,080,069 | A | | 6/2000 | Long | |
| RE36,950 | E | | 11/2000 | Allen | |
| 6,443,857 | B1 | * | 9/2002 | Chuang | 473/332 |
| 6,592,469 | B2 | | 7/2003 | Gilbert | |

(Continued)

FOREIGN PATENT DOCUMENTS

| | | | |
|---|---|---|---|
| JP | 07-031697 | A | 2/1995 |

(Continued)

*Primary Examiner*—Sebastiano Passaniti
(74) *Attorney, Agent, or Firm*—Hanify & King, P.C.

(57) ABSTRACT

A golf club head having a recess located in a top portion thereof is described and claimed. The recess is located between the heel and the toe and extends toward the sole. The recess may be in the top line of the club head. An insert may be placed within the recess. The insert has a density that is less than the density of the club head body, and the insert preferably is a light-weight insert. The insert may include one or more dampening materials. The recess removes material from the club head, which in turn may do one or more of the following: increase the overall size of the club head, expand the size of the club head sweet spot, lower the club head center of gravity, and/or produce a greater club head moment of inertia. Thus, the recess and insert produce a more forgiving and playable golf club.

20 Claims, 4 Drawing Sheets

U.S. PATENT DOCUMENTS

| | | | | |
|---|---|---|---|---|
| 6,773,361 | B1 | 8/2004 | Lee | |
| 6,902,495 | B2 | 6/2005 | Pergande et al. | |
| 6,921,344 | B2 | 7/2005 | Gilbert et al. | |
| 7,048,648 | B2 | 5/2006 | Breier et al. | |
| 2002/0042307 | A1* | 4/2002 | Deshmukh | 473/335 |
| 2002/0094883 | A1* | 7/2002 | Chuang | 473/332 |
| 2003/0045372 | A1 | 3/2003 | Vrska | |
| 2003/0092502 | A1 | 5/2003 | Pergande et al. | |
| 2003/0125129 | A1 | 7/2003 | Saksun | |
| 2005/0277484 | A1 | 12/2005 | Reed et al. | 473/332 |

FOREIGN PATENT DOCUMENTS

| | | | |
|---|---|---|---|
| JP | 3032837 | | 10/1996 |
| JP | 09-173513 | A | 7/1997 |
| JP | 09-225075 | A | 9/1997 |

* cited by examiner

GOLF CLUB HEAD WITH TOP LINE INSERT

BACKGROUND OF THE INVENTION

1. Field of the Invention

The present invention relates to a golf club, and, more particularly, to a golf club head having a top line recess with a light-weight insert.

2. Description of the Related Art

Golf club heads come in many different forms and makes, such as wood- or metal-type, iron-type (including wedge-type club heads), utility- or specialty-type, and putter-type. Each of these styles has a prescribed function and make-up. The present invention relates to golf club heads that have a predominantly solid material area located near the top of the club head.

Iron-type and utility-type golf club heads generally include a front or striking face, a top line, and a sole. The front face interfaces with and strikes the golf ball. A plurality of grooves, sometimes referred to as "score lines," is provided on the face to assist in imparting spin to the ball. The top line is generally configured to have a particular look to the golfer and to provide structural rigidity for the striking face. A portion of the face may have an area with a different type of surface treatment that extends fractionally beyond the score line extents. Some club heads have the surface treatment wrap onto the top line. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The set generally includes irons that are designated number 3 through number 9, and a pitching wedge. One or more additional long irons, such as those designated number 1 or number 2, and wedges, such as a lob wedge, a gap wedge, and a sand wedge, may optionally be included with the set. Each iron has a shaft length that usually decreases through the set as the loft for each club head increases from the long irons to the short irons. The overall weight of each club head increases through the set as the shaft length decreases from the long irons to the short irons. To properly ensure that each club has a similar feel or balance during a golf swing, a measurement known as "swingweight" is often used as a criterion to define the club head weight and the shaft length. Since each of the clubs within the set is typically designed to have the same swingweight value for each different lofted club head or given shaft length, the weight of the club head is confined to a particular range.

The length of the shaft, along with the club head loft, moment of inertia, and center of gravity location, impart various performance characteristics to the ball's launch conditions upon impact and dictate the golf ball's launch angle, spin rate, flight trajectory, and the distance the ball will travel. Flight distance generally increases with a decrease in loft angle. However, difficulty of use also increases with a decrease in loft angle.

Iron-type golf clubs generally can be divided into three categories: blades and muscle backs, conventional cavity backs, and modem multi-material cavity backs. Blades are traditional clubs with a substantially uniform appearance from the sole to the top line, although there may be some tapering from sole to top line. Similarly, muscle backs are substantially uniform, but have extra material on the back thereof in the form of a rib that can be used to lower the club head center of gravity. A club head with a lower center of gravity than the ball center of gravity facilitates getting the golf ball airborne. Since blade and muscle back designs have a small sweet spot, which is a term that refers to the area of the face that results in a desirable golf shot upon striking a golf ball, these designs are relatively difficult to wield and are typically only used by skilled golfers. However, these designs allow the skilled golfer to work the ball and shape the golf shot as desired.

Cavity backs are modern designs that move some of the club mass to the perimeter of the club by providing a hollow or cavity in the back of the club, opposite the striking face. This produces a more forgiving club with a larger sweet spot. Having a larger sweet spot increases the ease of use. The decrease in club head mass resulting from the cavity also allows the size of the club face to be increased, further enlarging the sweet spot. The perimeter weighting created by the cavity also increases the club's moment of inertia, which is a measurement of the club's resistance to torque, for example the torque resulting from an off-center hit. These clubs are easier to hit than blades and muscle backs, and are therefore usable by less-skilled and beginner golfers.

Modern multi-material cavity backs are the latest attempt by golf club designers to make cavity backs more forgiving and easier to hit. Some of these designs replace certain areas of the club head, such as the striking face or sole, with a second material that can be either heavier or lighter than the first material. These designs can also contain deep undercuts, which stem from the rear cavity, or secondary cavities. By incorporating materials of varying densities or providing cavities and undercuts, mass can be freed up to increase the overall size of the club head, expand the sweet spot, enhance the moment of inertia, and/or optimize the club head center of gravity location. However, due to construction limitations or requirements, some of these designs inadvertently thicken the top portion of the club head. Still, these improvements make the multi-material cavity back design the easiest of all styles to hit, and are ideally suited for the less adroit or novice golfer.

SUMMARY OF THE INVENTION

The present invention relates to a golf club head having a body defining a front surface, a top line, a sole, a back, a heel, a toe, and a hosel. The top portion of the club head, preferably the top line, contains a recess therein located between the heel and the toe, and extending toward the sole. This recess removes material from the club head, allowing the opportunity to do one or more of the following: increase the size of the overall club head, expand the size of the club head sweet spot, lower the club head center of gravity, and/or produce a greater moment of inertia measured about a vertical or horizontal axis passing through the club head center of gravity. The golf club head of the present invention preferably is an iron-type, a utility-type, or a putter-type golf club head.

An insert may be placed within the recess. The insert has a density that is less than the density of the club head body, and the insert preferably is a light-weight insert. This allows the mass removed by the recess to be replaced in more desirous locations on the club head, such as in the perimeter and/or toward the sole. The insert may contain one or more dampening materials, which have the added benefit of dissipating vibrations that may be created during the golf shot.

DESCRIPTION OF THE DRAWING

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values, and percentages, such as those for amounts of materials, moments of inertias, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
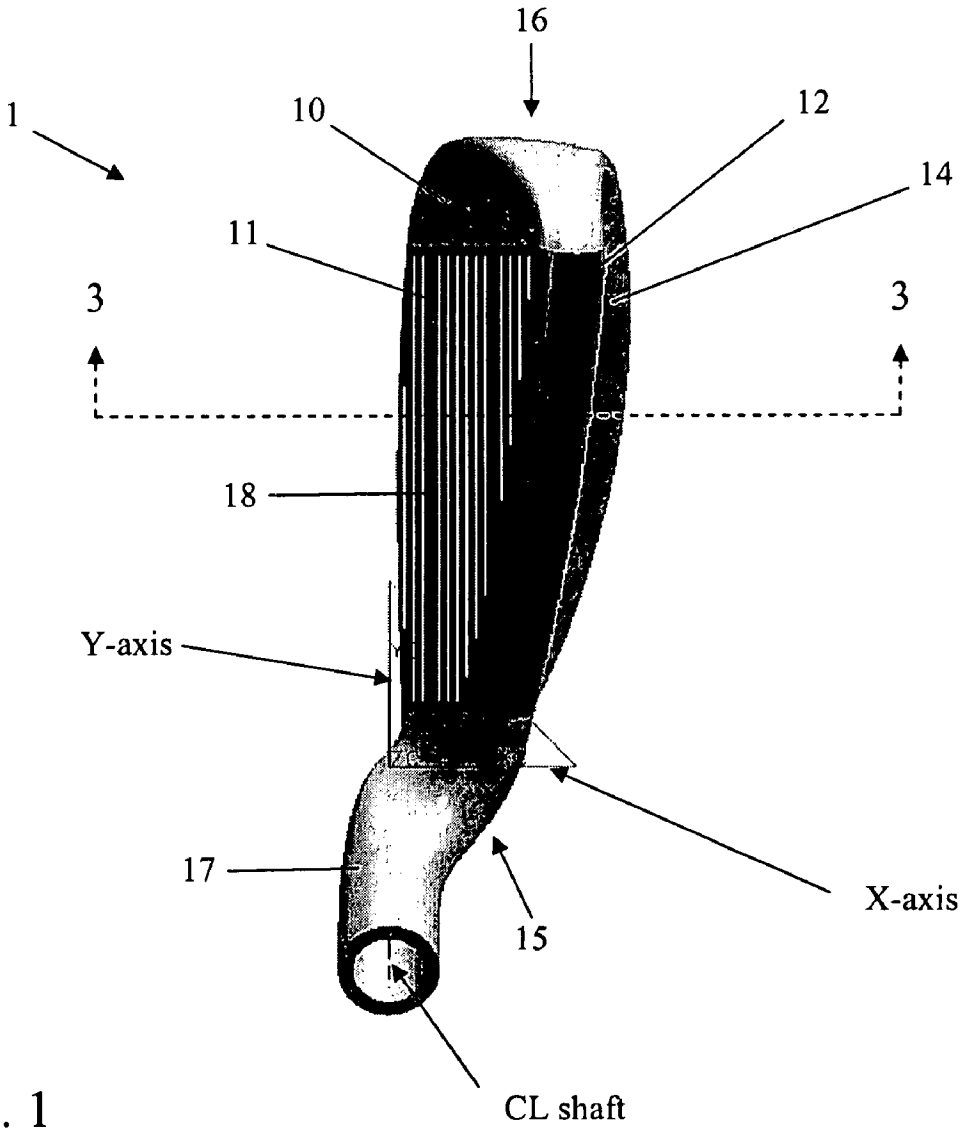
FIG. 1 is a top view of a golf club head of the present invention.
Figure 2:
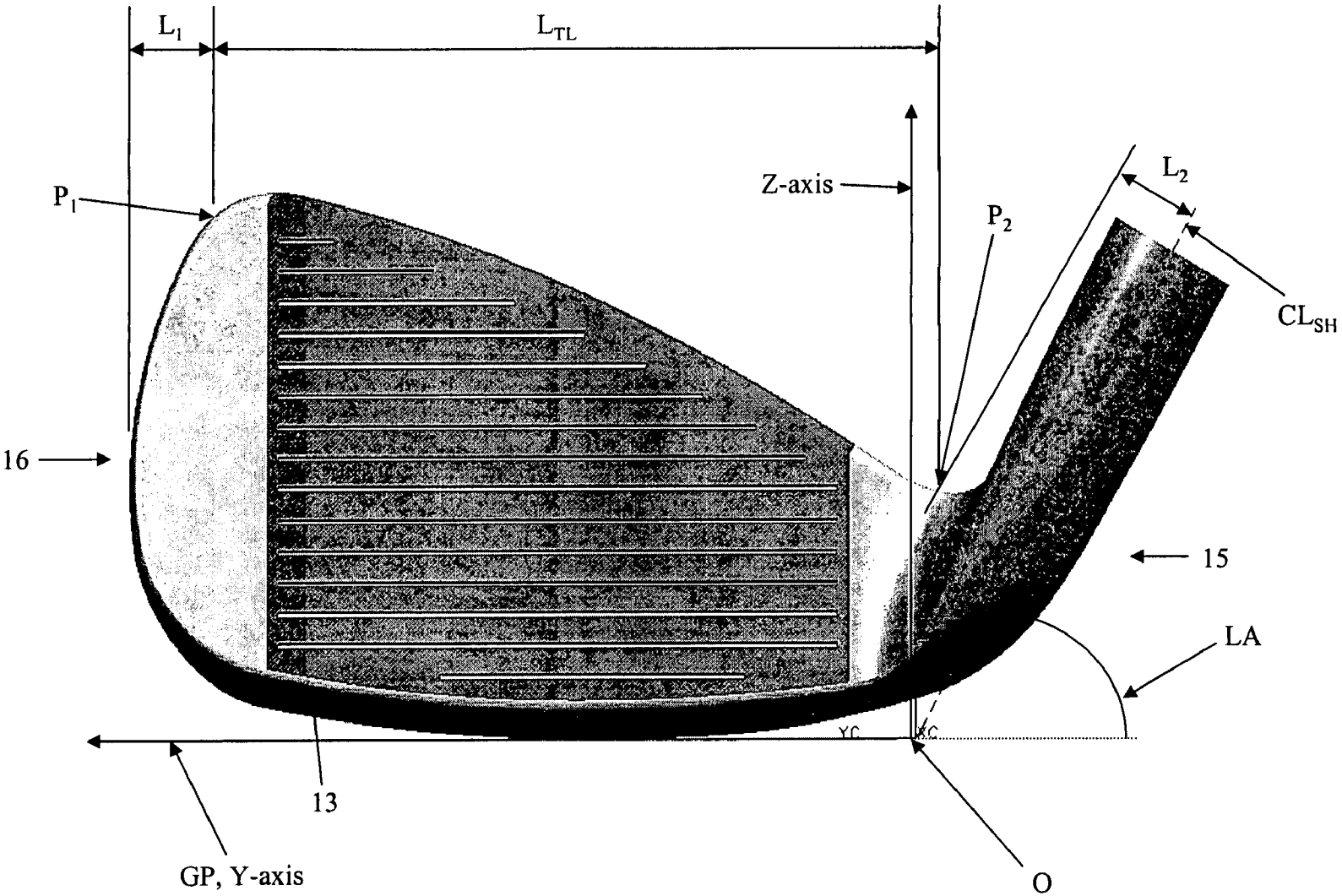
FIG. 2 is a front view of the golf club head of FIG. 1.

FIG. 1 is a top view of a golf club head 1 of the present invention, and FIG. 2 is a front view of the golf club head 1. The golf club head 1 includes a body 10 defining a front surface 11, a top line 12, a sole 13, a back 14, a heel 15, a toe 16, and a hosel 17. The striking face of the front surface 11, which preferably contains grooves 18 therein, and the sole 13 may be unitary with the body 10, or they may be separate bodies, such as inserts, coupled thereto. While the club head 1 is illustrated as an iron-type golf club head, the present invention may also pertain to a utility-type golf club head or a putter-type club head.

FIGS. 1 and 2 define a convenient coordinate system to assist in understanding the orientation of the golf club head 1 and other terms discussed herein. An origin O is located at the intersection of the shaft centerline $CL_{SH}$ and the ground plane GP, which is defined at a predetermined angle from the shaft centerline $CL_{SH}$, referred to as the lie angle LA, and tangent to the sole 13 at its lowest point. An X-axis is defined as a vector that is opposite in direction of the vector that is normal to the face 11 projected onto the ground plane GP. A Y-axis is defined as vector perpendicular to the X-axis and directed toward the toe 16. A Z-axis is defined as the cross product of the X-axis and the Y-axis.

The top portion of the club head 1 contains a recess 20 therein, located between the heel 15 and the toe 16 and extending toward the sole 13. Preferably, the recess 20 is located in the top line 12 of the club head 1 and extends along the top line 12 from approximately 10% to approximately 95% of the top line length. The top line length $L_{TL}$ is defined as the distance along the top line 12 from a point $P_1$ to a point $P_2$. Point $P_1$ is defined as the intersection of the golf club head 1 and a plane that is offset 0.2 inch ($L_1$) from and parallel to a plane defined by the X-axis and the Z-axis tangent to the toe 16 at the toe's furthest point from the origin O along the Y-axis. Point $P_2$ is defined as the uppermost intersection of the club head 1 and a plane that is parallel to the plane formed by the shaft centerline $CL_{SH}$ and the X-axis offset a distance of 0.3 inch ($L_2$) in a direction closer to the toe 16. The recess 20 removes material from the club head 1, which can be redistributed to other areas of the club head 1 to do one or more of the following: increase the overall size of the club head 1, expand the size of the club head sweet spot, reposition the club head center of gravity, and/or produce a greater moment of inertia (MOI) measured about either an axis parallel to the Y-axis or Z-axis passing through the club head center of gravity. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits since less energy is lost during impact from club head twisting. Moving or rearranging mass to the club head perimeter enlarges the sweet spot and produces a more forgiving club. Moving as much mass as possible to the extreme outermost areas of the club head 1, such as the heel 15, the toe 16, or the sole 13, maximizes the opportunity to enlarge the sweet spot or produce a greater MOI. The recess 20 preferably has a volume of approximately 0.001 $in^3$ to approximately 0.2 $in^3$. In relative terms, the recess 20 preferably has a volume that is from approximately 0.5% to approximately 10% of the volume of the body 10. The recess 20 preferably has a depth D from approximately 0.01 inch to approximately 0.25 inch, which may be a constant depth or a varying depth.

Figures 3, 4:
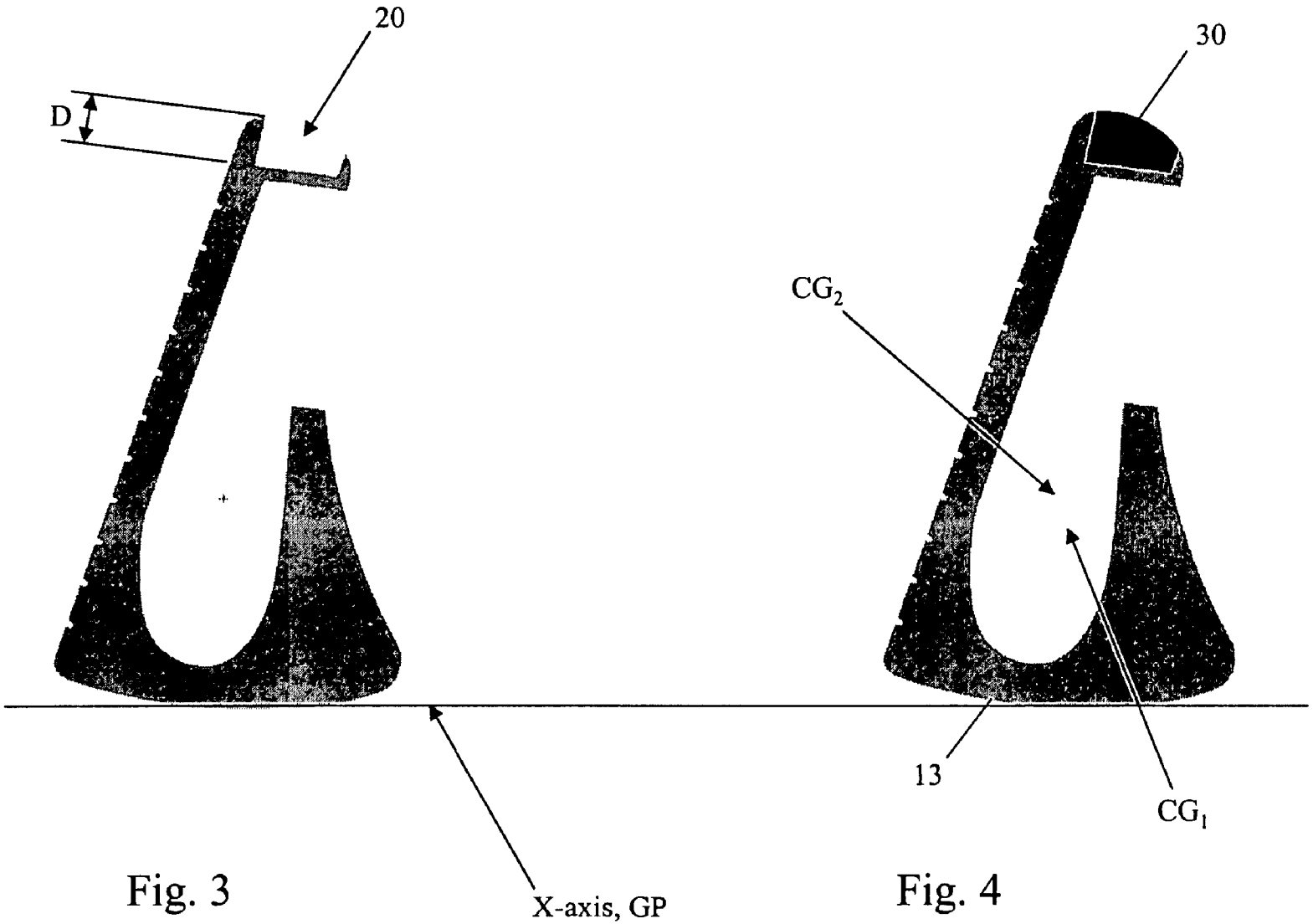
FIG. 3 is a cross-sectional view of the golf club head of FIG. 1 taken along lines 3-3.
FIG. 4 is a cross-sectional view of the golf club head of FIG. 1, including an insert, taken along lines 3-3.
Figure 6:
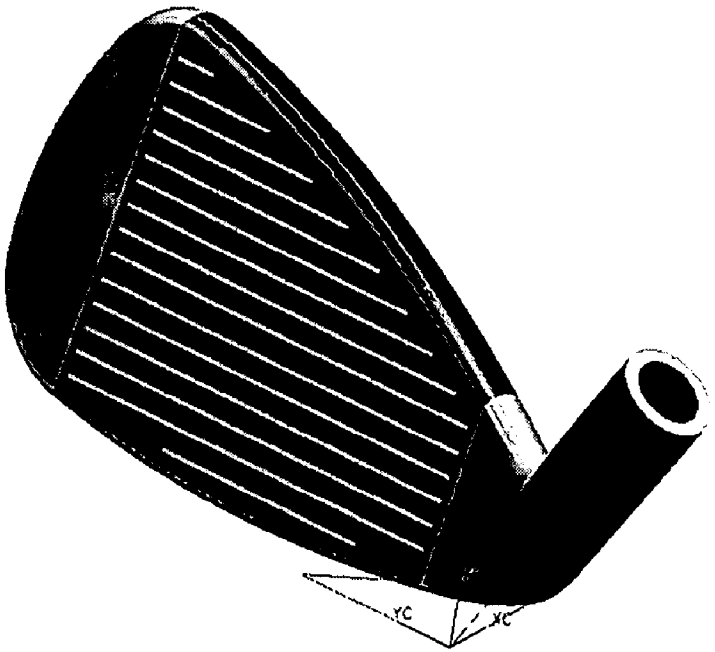
FIG. 6 shows a second isometric view of the golf club head of FIG. 1.
Figure 5:
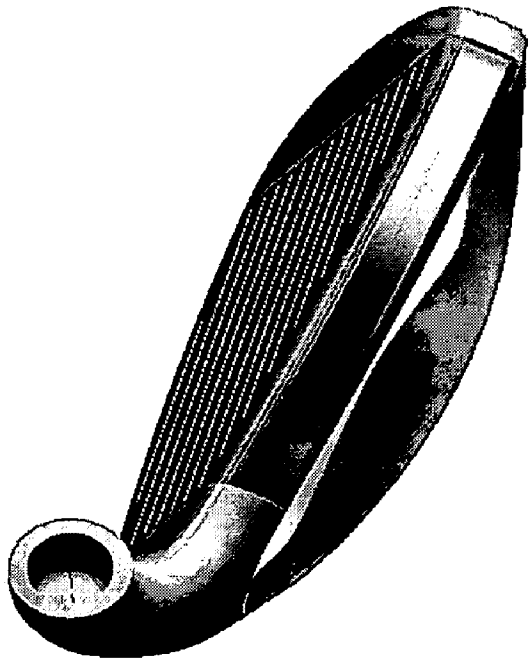
FIG. 5 shows a first isometric view of the golf club head of FIG. 1.

An insert 30 may be positioned within the recess 20. The insert 30, which may be either a preformed insert or cast in place within the recess 20, may be configured to matingly correspond to the recess 20. That is, the insert 30 may be formed and configured to match the contours of the recess 20 and to substantially fill the recess 20. Alternatively, the insert 30 fills only a portion of the recess 20. The insert 30 has a density that is less than the density of the club head body 10. Since the mass of the insert 30 is less than the mass removed by the recess 20, the extra mass may be replaced in more desirous locations on the club head 1. These locations may include, for example, the club head perimeter and/or the sole 13. Alternatively, no additional mass is added to the club head 1; only the recess 20 and the insert 30 are used to enhance the playing characteristics of the golf club. The insert 30 preferably has a density from approximately 0.5 $g/cm^3$ to approximately 5 $g/cm^3$, and is preferably less than the body density by at least 3 $g/cm^3$. The net effect of creating the recess 20 and adding the insert 30 lowers the club head center of gravity ($CG_1$ in FIG. 4) at least 0.01 inch toward the sole 13, as compared to the center of gravity location of a club head without the recess 20 and the insert 30 ($CG_2$ in FIG. 4). That is, the golf club head 1 has a center of gravity located at least 0.01 inch from a center of gravity location for a substantially similar golf club head without the recess 20 and the insert 30. More preferably, the club head center of gravity is lowered at least 0.025 inch toward the sole 13. Additionally, the recess 20 and the insert 30 increase the club head MOI measured about an axis parallel to the Z-axis and passing through the center of gravity by at least 20 gm•in$^2$. That is, the club head 1 has an increase in MOI measured about a vertical axis passing through said center of gravity of at least 20 gm•in$^2$ compared to a substantially similar golf club head without the recess 20 and the insert 30. Thus, the recess 20 and insert 30 produce a more forgiving and playable golf club. FIGS. 5 and 6 show isometric views of the golf club head 1.

The insert 30 may contain one or more dampening materials, which diminish vibrations in the club head, including vibrations generated during an off-center hit. Preferred dampening materials include those materials known as thermoplastic or thermoset polymers, such as rubber, urethane, polyurethane, butadiene, polybutadiene, silicone, and combinations thereof.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A golf club head, comprising:

a body having a front surface, a sole, a back, a heel, a toe, and a top; wherein:

said top defines a recess therein in a central region of the top between said heel and said toe and extending toward said sole, said top has a top line with a length and said recess being of varying depth between 0.01 inch to 0.25 inch within said top line and extending along said top line from 10% to 95% of said length, an insert being positioned within said recess;

said body is made of a first material having a first density, said insert is made of a second material having a second density, and said first density is greater than said second density;

a first thickness between said front surface and its corresponding rear surface adjacent said top line is less than a second thickness between said front surface and its corresponding rear surface at a central portion of the front surface; and said body has a first volume and said insert has a second volume, wherein the second volume is from 0.5% to 10% of the first volume.

2. The golf club head of claim 1, wherein said recess is located only in a top line of the club head.

3. The golf club head of claim 1, wherein said first density is greater than said second density by at least 3 g/cm$^3$.

4. The golf club head of claim 1, wherein said second density is from 0.5 g/cm$^3$ to 5 g/ cm$^3$.

5. The golf club head of claim 1, wherein said insert includes a vibration dampening material.

6. The golf club head of claim 5, wherein said vibration dampening material is a thermoplastic material or a thermoset material.

7. The golf club head of claim 6, wherein said vibration dampening material includes one or more of rubber, urethane, polyurethane, butadiene, polybutadiene, and silicone.

8. The golf club head of claim 1, wherein the club head has a center of gravity located at least 0.01 inch from a center of gravity location for a substantially similar golf club head without said recess and said insert.

9. The golf club head of claim 1, wherein the club head has a center of gravity; and the club head has an increase in a moment of inertia measured about a vertical axis passing through said center of gravity of at least 20 gm·in$^2$ compared to a substantially similar golf club head without said recess and said insert.

10. The golf club head of claim 1, wherein the club head is an iron-type club head.

11. The golf club head of claim 10, wherein the club head is a wedge-type club head.

12. The golf club head of claim 1, wherein the club head is a utility-type club head.

13. The golf club head of claim 1, wherein said recess has a concave profile extending into said top line and is defined by a plurality of walls located within said top line, said plurality of walls including at least a side wall and a bottom wall.

14. The golf club head of claim 1, wherein said recess displaces from 0.001 in$^3$ to 0.2 in$^3$ from said top line.

15. The golf club head of claim 1, comprising:

wherein said recess is defined in part by a body including a face and a rear cavity and a support member extending laterally away from a rear surface of said face above said rear cavity; and a light-weight insert positioned only in a top line of said body, said insert having a density from 0.5 g/cm$^3$ to 5 g/cm$^3$, said insert abutting said rear surface and said support member.

16. The golf club head of claim 1, wherein:

the golf club head is a cavity back golf club head; and said corresponding rear surface adjacent said top line defines a portion of said recess and said corresponding rear surface at said central portion of the front surface defines a portion of said cavity.

17. A golf club head, comprising a body comprising a front surface, a sole, a back, a heel, a toe, and a top, wherein the top comprises a top line with a length, and wherein the top comprises a recess between the heel and the toe that extends along the top line approximately 10% to 95% of the top line length and a varying depth that extends toward the sole, wherein an insert formed from a first material having a first density is positioned within the recess, and wherein the body comprises a second material having a second density greater than the first density, and wherein the body has a first thickness between the front surface and its corresponding rear surface adjacent the top line that is less than a second thickness between the front surface and its corresponding rear surface at a central portion of the front surface.

18. The golf club head of claim 17, wherein the club head has a center of gravity and the club head has an increase in a moment of inertia measured about a vertical axis passing through the center of gravity of at least 20 gm·in$^2$ compared to a substantially similar golf club head without the recess and the insert.

19. The golf club head of claim 17, wherein the first density is less than the second density by at least 3 g/cm$^3$.

20. The golf club head of claim 17, wherein the varying depth is from 0.01 inch to 0.25 inch.

* * * * *